US007768203B2

(12) United States Patent
Ahn

(10) Patent No.: US 7,768,203 B2
(45) Date of Patent: Aug. 3, 2010

(54) PLASMA DISPLAY PANEL INCLUDING BLACK PROJECTIONS

(75) Inventor: Jung-Keun Ahn, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 532 days.

(21) Appl. No.: 11/730,453

(22) Filed: Apr. 2, 2007

(65) Prior Publication Data

US 2007/0257617 A1 Nov. 8, 2007

(30) Foreign Application Priority Data

May 8, 2006 (KR) ..... 10-2006-0041098

(51) Int. Cl.
*H01J 17/49* (2006.01)

(52) U.S. Cl. ..... 313/585; 313/582; 445/23

(58) Field of Classification Search ..... 313/582, 313/583, 584, 585, 586, 597, 587; 445/23–25; 345/60; 315/169.1, 169.3
See application file for complete search history.

(56) References Cited

U.S. PATENT DOCUMENTS 6,531,819 B1 * 3/2003 Nakahara et al. ..... 313/584
2003/0090204 A1 * 5/2003 Joo et al. ..... 313/582
2005/0194902 A1 * 9/2005 Su ..... 313/585
2007/0001603 A1 * 1/2007 Park ..... 313/582

FOREIGN PATENT DOCUMENTS

JP 2005-302741 A 10/2005

* cited by examiner

*Primary Examiner*—Toan Ton
*Assistant Examiner*—Andrew J Coughlin
(74) *Attorney, Agent, or Firm*—Lee & Morse, P.C.

(57) ABSTRACT

A plasma display panel may include first and second substrates facing each other and spaced apart from each other, barrier ribs between the first and second substrates, the barrier ribs defining discharge cells to define discharge and non-discharge regions, address electrodes extending in a first direction in respect to the discharge cells, and first and second electrodes formed on the second substrate and extending in a second direction intersecting the first direction, where at least one of the first and second electrodes includes black projections extending from the discharge region to the non-discharge region.

18 Claims, 4 Drawing Sheets

PLASMA DISPLAY PANEL INCLUDING BLACK PROJECTIONS

BACKGROUND OF THE INVENTION

1. Field of the Invention

The present invention relates to a plasma display panel. More particularly, the present invention pertains to a plasma display panel that may enhance a light emission uniformity of discharge cells, even when electrodes are formed with non-transparent bus lines.

2. Description of Related Art

Generally, a plasma display panel (PDP) is a display device that may display an image using red, green and blue visible light created by exciting phosphors using vacuum ultraviolet (VUV) rays emitted from a plasma-generated gas discharge.

In an alternating current (AC) plasma display panel, address electrodes may be formed on a rear substrate. The address electrodes may be covered by a dielectric layer. Barrier ribs may be are arranged in a stripe pattern on the dielectric layer between the address electrodes. Red, green and blue phosphor layers may be formed on the barrier ribs. Multiple display panels, each having a pair of sustain and scan electrodes, may be arranged on a surface opposite to the front surface or the rear surface. The display electrodes may extend in a direction crossing the address electrodes. The display electrodes may be covered by a dielectric layer and an MgO passivation layer. Discharge may be are formed at regions where the address electrodes formed on the rear substrate cross the sustain and scan electrodes formed on the front substrate. Typically, millions of the discharge cells may be arranged in a matrix pattern in the plasma display panel.

A memory property may be used for driving the discharge cells of the plasma display panel. In order to generate the discharge between the sustain and scan electrodes, a potential difference higher than a specific voltage may be required. This boundary voltage may be called a firing voltage (Vf). When scan and address voltages are respectively applied to the scan and address electrodes, the discharge may be generated between the scan and address electrodes to generate plasma in the discharge cell. Electrons and ions of the plasma may travel to electrodes having polarities opposite to those of the electrons and ions.

A dielectric layer may be deposited on each electrode of the plasma display panel so that most of space charges may accumulate on the dielectric layer having an opposite polarity. As a result, since net space potential between the scan and address electrodes is to be lower than an initially applied address voltage (Va), the address discharge may weaken and disappear. At this point, a relatively small amount of electrons may accumulate on the sustain electrodes and a relatively large amount of electrons may accumulate on the scan electrodes. The charges accumulated on the dielectric layer covering the sustain and scan electrodes may be called wall charges (Qw). A space voltage generated between the sustain and scan electrodes by the wall charges may be called a wall voltage (Vw).

When a discharge sustain voltage (Vs) is applied to the sustain and scan electrodes, and a sum (Vs+Vw) of the discharge sustain voltage (Vs) and the wall voltage (Vw) is higher than the firing voltage (Vf), a sustain discharge may occur in the discharge cells to thereby generate vacuum ultraviolet. The vacuum ultraviolet may excite the corresponding phosphor layer to emit visible light through the transparent front panel.

However, when there is no address discharge between the scan and address electrodes, i.e., when no address voltage (Va) is applied, the wall charges may not accumulate between the sustain and scan electrodes. As a result, no wall voltage may exist between the sustain and scan electrodes. At this point, only the discharge sustain voltage (Vs) applied to the sustain and scan electrodes may be formed in the discharge cells. Since the discharge sustain voltage may be lower than the firing voltage (Vf), the gas space defined between the sustain and scan electrodes may not discharge.

The general plasma display panel may include an active region (a discharge region) emitting visible light using a sustain discharge in the discharge cells. The general plasma display panel may also include an inactive region (a non-discharge region), defined between adjacent discharge cells, which may not emit visible light. The non-discharge region may include a black portion, e.g., a black stripe, to enhance bright room contrast of the plasma display panel by absorbing external light. The black stripe may be formed through a process that is independent from a process for forming the sustain and scan electrodes, thereby making the manufacturing process of the plasma display panel complicated.

A piece of black stripe formed on the inactive region between the adjacent discharge cells may define a first gap by being spaced apart from a sustain electrode of one of the adjacent discharge cells. The piece of black stripe may also define a second gap by being spaced apart from a scan electrode of the other of the adjacent discharge cells. Since two gaps may be formed in one inactive region, it may thus be difficult to enlarge an area of the black portion in a limited area of the inactive area.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention is therefore directed to a plasma display panel including black projections which substantially overcomes one or more of the problems due to the limitations and disadvantages of the related art.

It is therefore a feature of an embodiment of the invention to provide a method of making a plasma display panel including black projections.

At least one of the above and other features and advantages of the present invention may be realized by providing a plasma display panel which may include first and second substrates facing each other and spaced apart from each other, barrier ribs between the first and second substrates, the barrier ribs defining discharge cells having discharge and non-discharge regions, address electrodes extending in a first direction along the discharge cells, and first and second electrodes formed on the second substrate and extending in a second direction intersecting the first direction, where at least one of the first and second electrodes may include black projections extending from the discharge region to the non-discharge region.

The black projections may include first black projections which may extend from the first electrode and are spaced apart from each other, and second black projections which may extend from the second electrode and are between the first black projections. The first black projections may be arranged on the barrier ribs, and an extending end of each first black projection in the first direction may entirely on a top edge of the barrier ribs. The second black projections may be on the barrier ribs, and an extending end of each second black projection in the first direction may be entirely on a top edge of the barrier ribs. Gaps may be formed between the first and second black projections, and the gaps may be interconnected and staggered in the first and second directions at the non-discharge region between the adjacent discharge cells.

Each of the first and second electrodes may include a transparent electrode extending toward a central portion of the respective discharge cell of the discharge cells, and a bus electrode provided on the transparent electrode may extend in the second direction. The black projections may extend from at least one of the bus electrodes of the respective first and second electrodes. The black projections may include first black projections which extend from the bus electrode of the first electrode and are spaced apart from each other, and second black projections which may extend from the bus electrode of the second electrode and are between the first black projections. The first black projections may be on the barrier ribs, and an extending end of each first black projection in the first direction may be entirely on a top edge of the barrier ribs. The second black projections may be on the barrier ribs, and an extending end of each second black projection in the first direction may be entirely on a top edge of the barrier ribs. Each of the bus electrodes may include a white layer formed on the transparent electrode, and a black layer formed on the white layer, the black projections extending from the black layer. The black projections may extend in the first direction by about 60-80 μm.

At least one of the above and other features and advantages of the present invention may be realized by providing a method for forming a plasma display panel, which may include providing first and second substrates to be spaced apart from each other, providing barrier ribs between the first and second substrates to form discharge cells having discharge and non-discharge regions, extending address electrodes in a first direction along the discharge cells, and forming first and second electrodes on the second substrate to extend in a second direction intersecting the first direction, where at least one of the first and second electrodes includes black projections which may extend from the discharge region to the non-discharge region.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
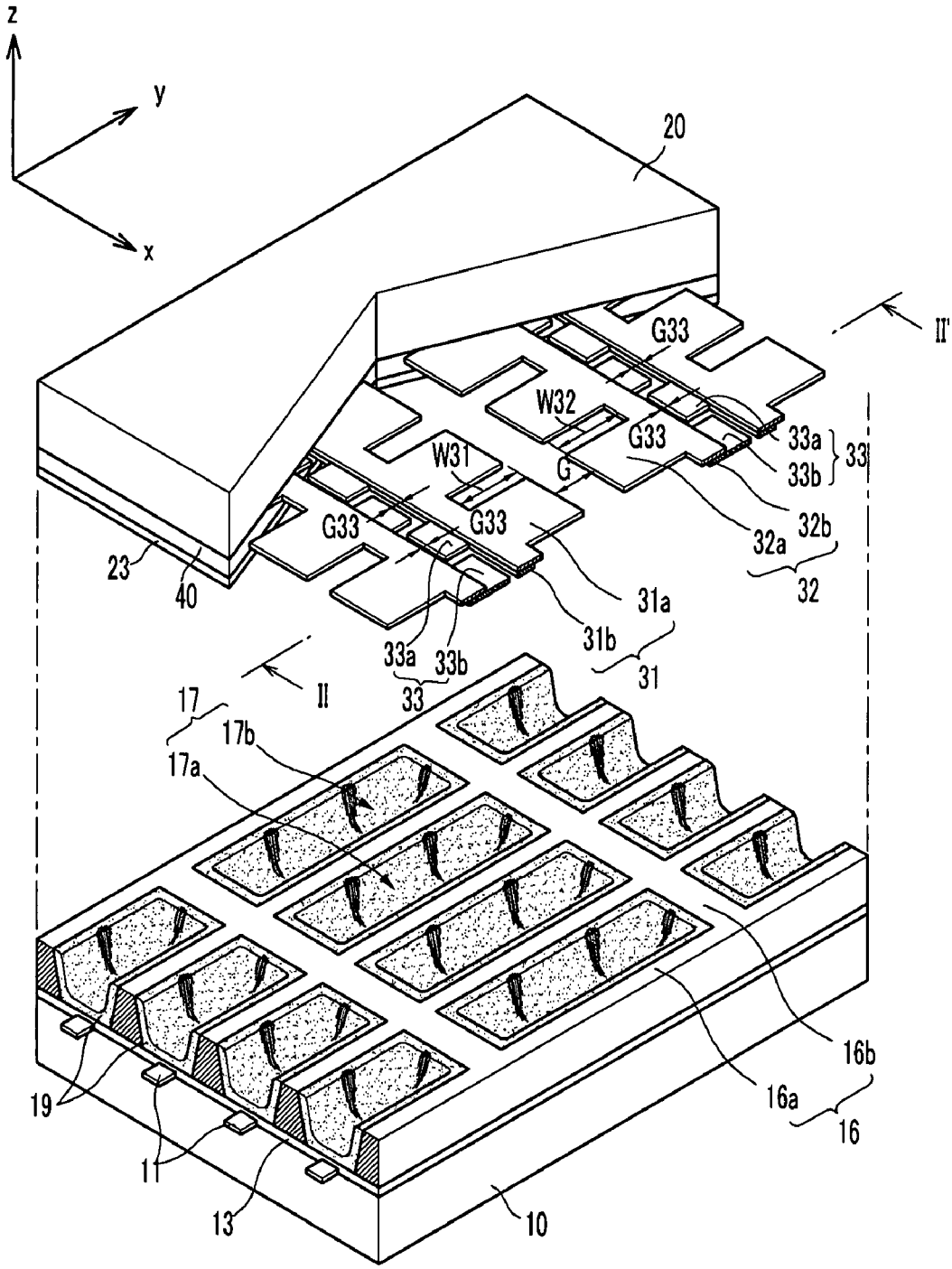
FIG. 1 illustrates a schematically exploded perspective view of a plasma display panel according to an exemplary embodiment of the present invention.

Korean Patent Application No. 10-2006-0041098, filed on May 8, 2006, in the Korean Intellectual Property Office, and entitled: "Plasma Display Panel," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
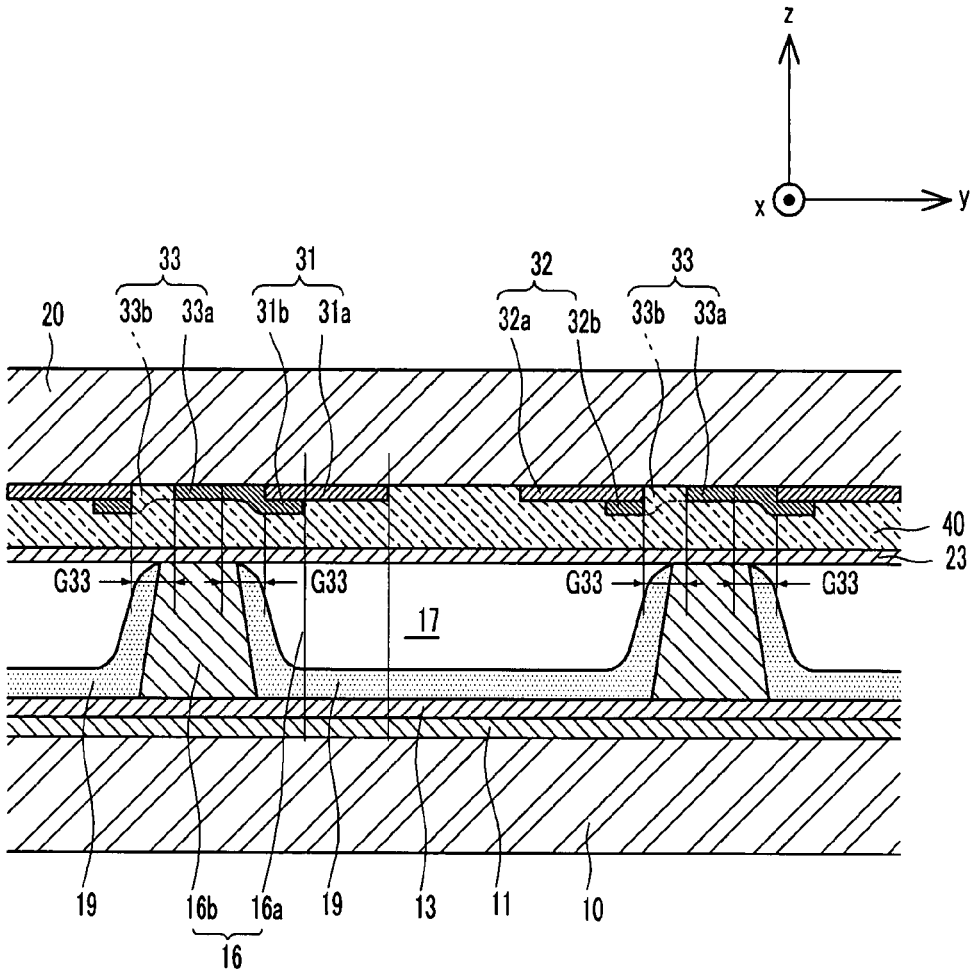
FIG. 2 illustrates a sectional view taken along line II-II' of FIG. 1.

FIG. 1 illustrates a schematic exploded perspective view of a plasma display panel according to an exemplary embodiment of the present invention. FIG. 2 illustrates a sectional view taken along line II-II' of FIG. 1.

Referring to FIGS. 1 and 2, a plasma display panel may include first and second substrates (hereinafter, "rear and front substrates") 10 and 20 facing each other at a predetermined interval and sealed together. Barrier ribs 16 may be between the rear and front substrates 10 and 20.

The barrier ribs 16 may be formed at a predetermined height between the rear and front substrates 10 and 20 to define multiple discharge cells 17. The discharge cells 17 may be filled with a discharge gas, e.g., a gas mixture including neon (Ne), xenon (Xe), etc., to create vacuum ultraviolet rays via gas discharge. The discharge cells 17 may have phosphor layers 19 for absorbing the vacuum ultraviolet rays and emitting visible light.

In order to display an image using the gas discharge, the plasma display panel may include address electrodes 11, first electrodes (hereinafter, "sustain electrodes") 31, and second electrodes (hereinafter, "scan electrodes") 32. The address, sustain and scan electrodes 11, 31 and 32 may be arranged between the rear and front substrates 10 and 20 at areas corresponding to the discharge cells 17.

The address electrodes 11 may extend in a direction (the y-axis in the drawings) on an inner surface of the rear substrate 10 to continuously correspond to the discharge cells 17 adjacent to each other along the y-axis. The address electrodes 11 may be arranged in parallel in a manner corresponding in location to the discharge cells 17*a*, 17*b* adjacent to each other in a second direction (the x-axis in the drawings) crossing the y-axis.

The address electrodes 11 may be covered by a first dielectric layer 13 on an inner surface of the rear substrate 10. The dielectric layer 13 may prevent the address electrodes 11 from being damaged by preventing positive ions or electrons from directly colliding with the address electrodes 11. The first dielectric layer 13 may also generate and accumulate wall charges. Since the address electrodes 11 are arranged on the rear substrate 10 so as not to interfere with the irradiation of the visible light toward the front substrate 20, the address electrodes 11 may be formed of a nontransparent material. The address electrodes 11 may be formed of metal that has a high level of electric conductivity.

The barrier ribs 16 may be provided on the first dielectric layer 13 so as to define the discharge cells 17. The barrier ribs 16 may include first barrier members 16*a* extending along the y-axis and second barrier members 16*b* extending along the x-axis between the first barrier members 16*a*. The first and second barrier members 16*a* and 16*b* may form the discharge cells 17 in a matrix structure.

The phosphor layer 19 formed in each discharge cell 17 may be formed by depositing fluorescent paste on a sidewall of the barrier ribs 16 and a surface of the first dielectric layer 13 between the barrier ribs 16, and then drying and baking the deposited fluorescent paste.

The phosphor layers 19 formed in the discharge cells 17 arranged along the y-axis may be formed of phosphors of substantially identical color. The phosphor layers 19 formed in the discharge cells 17*a*, 17*b* arranged along the x-axis, may be formed of a repeating pattern of red, green, and blue phosphors R, G and B.

Referring to FIG. 2, the sustain and scan electrodes 31 and 32 may be on an inner surface of the front substrate 20 to form surface discharge structures corresponding to the respective discharge cells 17, which may induce the gas discharge in the discharge cells 17. The sustain and scan electrodes 31 and 32 may extend along the x-axis crossing the address electrodes 11.

Each of the sustain and scan electrodes 31 and 32 may respectively include a transparent electrode 31*a* and 32*a* generating the discharge. Each of the sustain and scan electrodes 31 and 32 may also include a bus electrode 31*b* and 32*b* applying a voltage signal to the respective transparent electrode 31*a* and 32*a*.

The transparent electrodes 31*a* and 32*a* may be portions where the surface discharge occurs in the discharge cells 17. The transparent electrodes 31*a* and 32*a* may be formed of a transparent material, e.g., indium tin oxide (ITO), indium zinc oxide (IZO), indium tin zinc oxide (ITZO), etc., to provide a sufficient aperture ratio for the discharge cells 17. The bus electrodes 31*b* and 32*b* may be formed of metal having a high level of electric conductivity in order to compensate for the high electric resistance of the transparent electrodes 31*a* and 32*a*.

Figure 3:
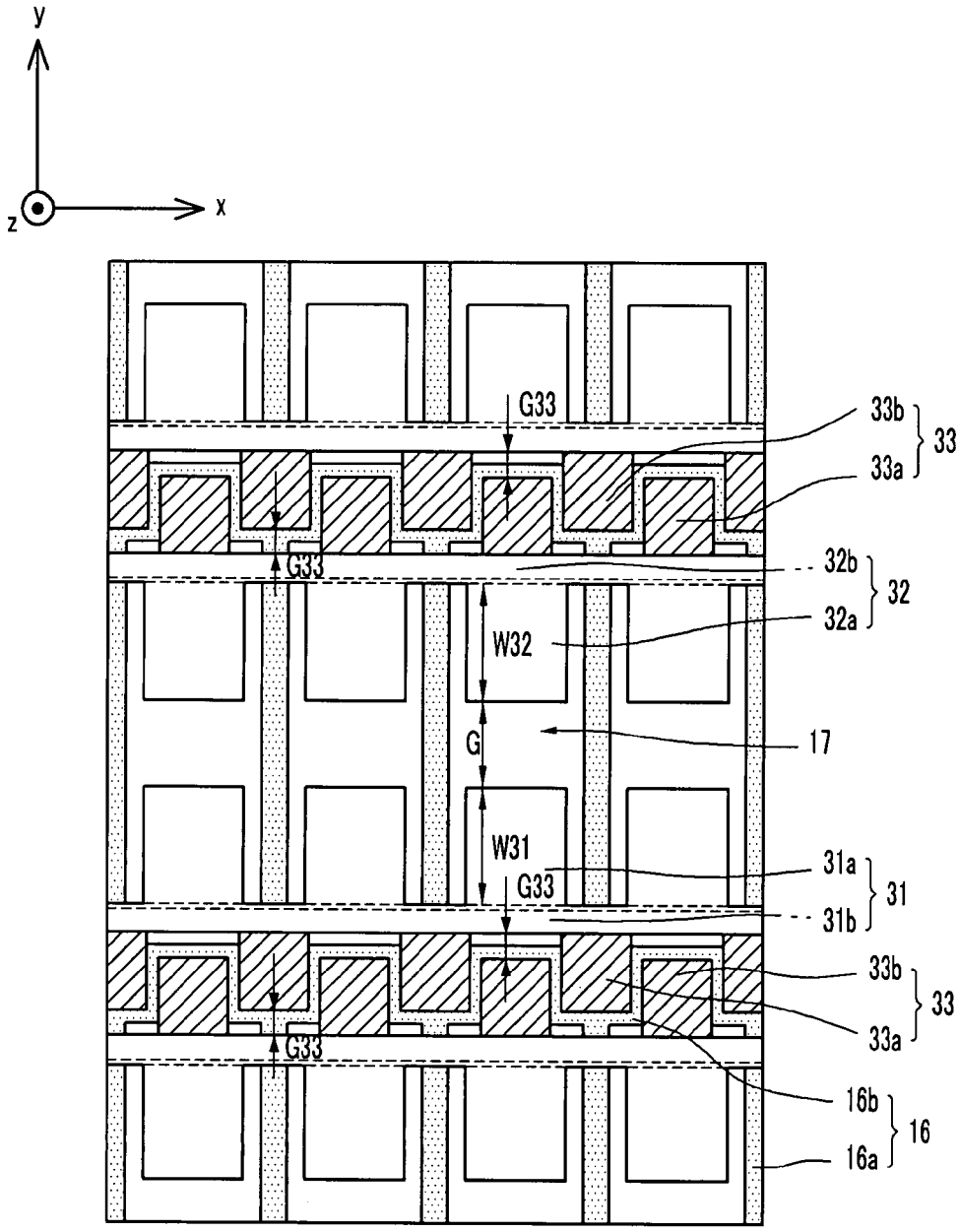
FIG. 3 illustrates a top plane view of an arrangement of barrier ribs and electrodes of the plasma display panel of FIG. 1.

Referring to FIG. 3, the transparent electrodes 31*a* and 32*a* may extend respectively from opposite ends of the discharge cell 17 to a central portion of the discharge cell 17 along the y-axis, and may respectively have widths W31 and W32 to define a surface discharge structure and to form a discharge gap G at the central portion of the discharge cell 17.

The bus electrodes 31*b* and 32*b* may be arranged on the transparent electrodes 31*a* and 32*a* at opposite end portions of the discharge cells 17. The bus electrodes 31*b* and 32*b* may extend along the x-axis. Therefore, when the voltage signal is applied to the bus electrodes 31*b* and 32*b*, the voltage signal may be applied to the transparent electrodes 31*a* and 32*a* connected to the respective bus electrodes 31*b* and 32*b*.

The plasma display panel may include an active region (a discharge region), corresponding to the discharge cells 17, which emits visible light, and the plasma display panel may also include an inactive region (a non-discharge region), corresponding to the barrier ribs 16, where the visible light does not emit.

One of the sustain and scan electrodes 31 and 32 located on the discharge cell 17 may be provided with black projections 33 extending from the discharge region to the non-discharge region.

The black projections 33 may include first black projections 33*a* extending from the sustain electrode 31 and second black projections 33*b* extending from the scan electrode 32. The first and second black projections 33*a* and 33*b* may be alternately arranged along the x-axis. The black projections 33 may extend along the y-axis by, e.g., about 60-80 μm. Other suitable extensions along the y-axis can be used, e.g., in a range of about 40-100 μm.

The sustain and scan electrodes 31 and 32 may include the respective first and second black projections 33*a* and 33*b* extending from the discharge cells 17 to the barrier ribs 16. The first and second black projections 33*a* and 33*b* may improve bright room contrast by absorbing external light at the non-discharge region above the barrier ribs 16.

The first and second black projections 33*a* and 33*b* may be integrally formed with the sustain and scan electrodes 31 and 32, respectively. The first and second black projections 33*a* and 33*b* may be formed together with the sustain and scan electrodes 31 and 32 during a process for forming the sustain and scan electrodes 31 and 32, thereby simplifying the manufacturing process of the plasma display panel.

The first black projections 33*a* may be arranged on the second barrier members 16*b* defining a sustain electrode side discharge cell and a scan electrode side discharge cell among adjacent discharge cells 17. An end of the first black projection 33*a* may thus be entirely on a top edge of the second barrier member 16*b* on an x-y plane of the front substrate 20 in the direction of the y-axis (see FIGS. 2 and 3).

The second black projections 33*b* may be arranged on the second barrier members 16*b* to define the sustain electrode side discharge cell and the scan electrode side discharge cell among the adjacent discharge cells 17. Therefore, an end of the second black projection 33*b* may be located to entirely on a top edge of the second barrier member 16*b* on the x-y plane of the front substrate 20 in the direction of the y-axis (see FIG. 3).

Since the first and second black projections 33*a* and 33*b* may be located to entirely on the top edge of the second barrier member 16*b* that is the non-discharge region, the first and second black projections 33*a* and 33*b* may not affect the sustain discharge, and an increase of the power consumption due to the increase of areas of the sustain and scan electrodes 31 and 32 may thus be prevented. Also, the first and second black projections 33*a* and 33*b* may be located to substantially on the top edge of the second barrier member 16*b* that is the non-discharge region Generally, when voltages are applied to the sustain and scan electrodes 31 and 32 to induce the sustain discharge, the power consumption of the sustain and scan electrodes 31 and 32 may increase as the area of the sustain and scan electrodes 31 and 32 increases.

In the present invention, although the first and second black projections 33*a* and 33*b* integrally extend from the sustain and scan electrodes 31 and 32, the first and second black projections 33*a* and 33*b* may not induce discharge since they are shielded by the second barrier member 16*b*. Therefore, the power consumption of the sustain and scan electrodes 31 and 32 may be reduced during the sustain discharge.

Gaps G33 each having a predetermined width may be formed between the first and second black projections 33*a* and 33*b* on the second barrier member 16*b* which is in the non-discharge region. The gaps G33 may be interconnected while being staggered along the y and x-axes at the non-discharge region between the adjacent discharge cells 17. Since the gaps G33 may be formed at the non-discharge region, electric shorts and any unnecessary discharge by the first and second black projections 33*a* and 33*b* may be prevented.

Since the first and second black projections 33*a* and 33*b* form the gap G33 having a predetermined width at the non-discharge region, the area of the black portion may be maximized within a limited area of the non-discharge region, thereby further improving the bright room contrast.

In the present invention, black projections 33 including the first and second black projections 33*a* and 33*b* may be respectively formed on the sustain and scan electrodes 31 and 32. However, the present invention is not limited to this case. The black projections 33 may also include only the first black projections 33*a* extending from the sustain electrode 31. Alternatively, the black projections 33 may include only the second black projections 33*b* extending from the scan electrode 32.

That is, one of the first and second black projections 33*a* and 33*b* may be omitted. Therefore, the drawing illustrating this structure will be omitted.

In addition, the black projections 33 may be formed extending along the x-axis on the second barrier member 16*b*. In this case, the black projections 33 may be formed on one or both of the sustain and scan electrodes 31 and 32.

The black projections will be described in more detail with reference to FIG. 2.

The black projections 33 may be formed extending from at least one of the bus electrode 31*b* of the sustain electrode 31 or the bus electrode 32*b* of the scan electrode 32. The black projections 33 may include the first black projections 33*a* extending from the bus electrode 31*b* of the sustain electrode 31 and the second black projections 33*b* extending from the bus electrode 32*b* of the scan electrode 32. The first and second black projections 33*a* and 33*b* may be alternately arranged along the x-axis.

The first and second black projections 33*a* and 33*b* may be integrally formed with the bus electrodes 31*b* and 32*b* of the respective sustain and scan electrodes 31 and 32, respectively. The first and second black projections 33*a* and 33*b* may be formed together with the sustain and scan electrodes 31 and 32 during a process for forming the bus electrodes 31*b* and 32*b* of the sustain and scan electrodes 31 and 32, thereby simplifying the manufacturing process of the plasma display panel.

The first black projections 33*a* may be arranged on the second barrier members 16*b* defining the discharge cell 17 near the bus electrode 32*b* of the sustain electrode 31 and the discharge cell 17 near the bus electrode 32*b* of the scan electrode 32 among the adjacent discharge cells 17. Therefore, ends of the first black projections 33*a* may be located to entirely on a top edge of the second barrier member 16*b* on an x-y plane of the front substrate 20 in the direction of the y-axis (see FIGS. 2 and 3).

The second black projections 33*b* may be arranged on the second barrier members 16*b* defining the discharge cells 17 near the bus electrode 32*b* of the sustain electrode 31, and the second black projections 33*b* may be similarly arranged on the second barrier members 16*b* of the adjacent discharge cells 17. Ends of the first black projections 33*a* may be located to be entirely on top edge of the second barrier members 16*b* on an x-y plane of the front substrate 20 in the direction of the y-axis (see FIG. 3).

Referring again to FIGS. 1 and 2, the sustain and scan electrodes 31 and 32 may be arranged to correspond to the discharge cells 17 crossing the address electrodes 11. The sustain and scan electrodes 31 and 32 may face each other while being covered by a dielectric layer 40. The dielectric layer 40 may protect the sustain and scan electrodes 31 and 32 from the gas discharge, and the dielectric layer 40 may generate and accumulates wall charges.

The dielectric layer 40 may be covered by a passivation layer 23. The passivation layer 23 may function to protect the dielectric layer 40 and increase an emission amount of secondary electrons.

When the plasma display panel is driven, a reset discharge may be generated by a reset pulse applied to the scan electrodes 32 during a reset period. In a period (an addressing period) following the reset period, an address discharge may be generated by a scan pulse applied to the scan electrodes 32 and an address pulse applied to the address electrodes 11. Next, in a sustain period, a sustain discharge may be generated by a sustain pulse that may be alternately applied to the sustain and scan electrodes 31 and 32.

The sustain and scan electrodes 31 and 32 may apply the sustain pulse required for the sustain discharge. The scan electrodes 32 may apply the reset and scan pulses. The address electrodes 11 may apply the address pulse. The sustain, scan and address electrodes 31, 32 and 11 may vary their functions depending on voltage waveforms respectively applied thereto. The functions of these electrodes are not limited to those described above.

The plasma display panel may select discharge cells 17 to be turned on by the address discharge resulting from the interaction between the address and scan electrodes 11 and 32, and the selected discharge cells 17 may be driven using the sustain discharge resulting from the interaction between the sustain and scan electrodes 31 and 32, thereby displaying an image.

Figure 4:
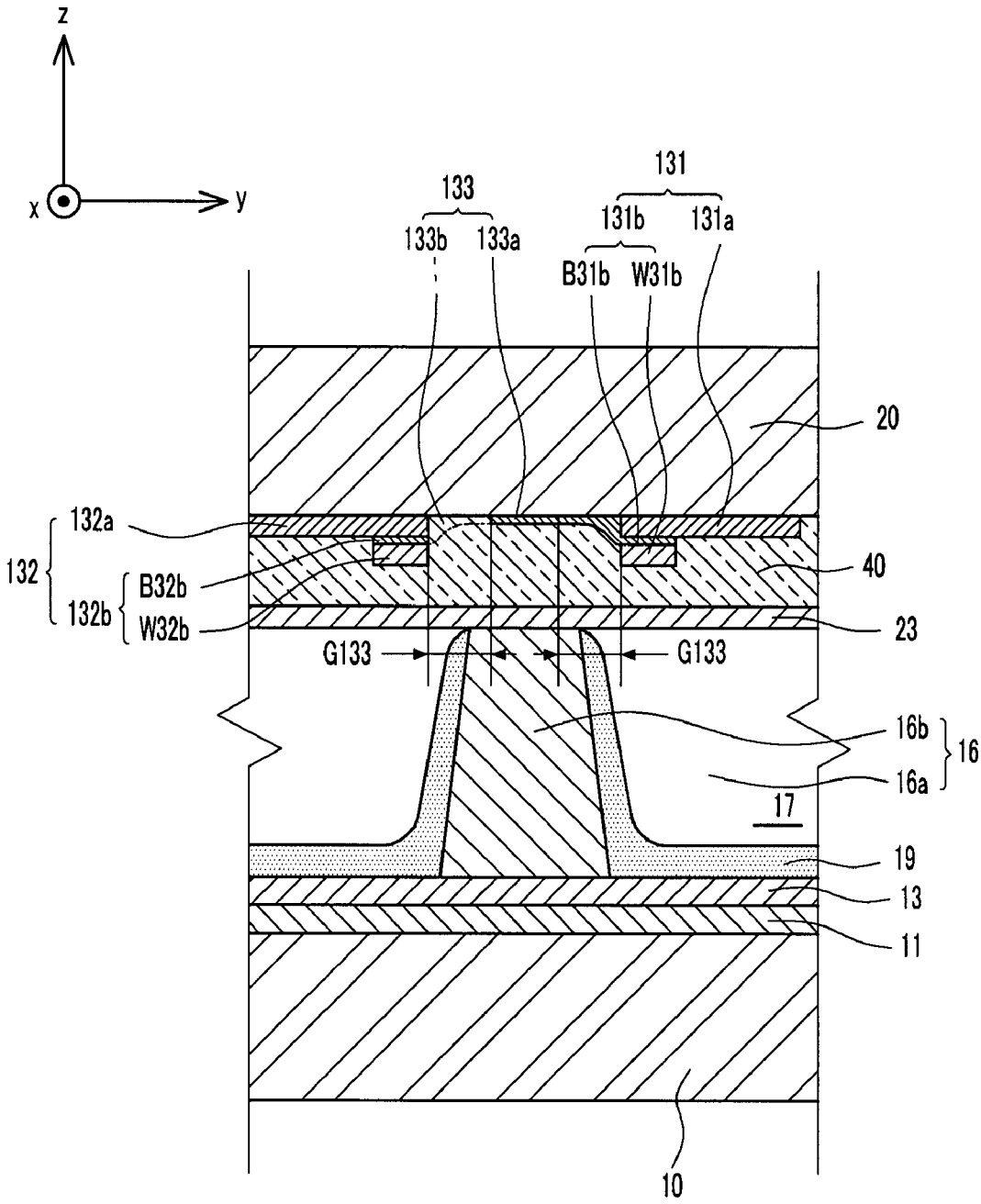
FIG. 4 illustrates a sectional view of a plasma display panel according to an exemplary embodiment of the present invention.

FIG. 4 illustrates a sectional view of a plasma display panel according to a second embodiment of the present invention.

A plasma display panel of this embodiment may be identical to that of the first embodiment except for the structure of the bus electrodes.

Each of bus electrodes 131*b* and 132*b* of the scan electrodes 131 and 132 may respectively include black layers B31*b* and B32*b* formed on the transparent electrodes 131*a* and 132*a* and white layers W31*b* and W32*b* formed on the black layers B31*b* and B32*b*. The white layers W31*b* and W32*b* may improve the conductivity of the respective bus electrodes 131*b* and 132*b*, and the black layers B31*b* and B32*b* may also improve the bright room contrast.

Black projections 133 may extend from the black layers B31*b* and B32*b*. The black projections 133 may include first black projections 133*a* extending from the black layers B32*b* of the sustain electrodes 131 and second black projections 133*b* extending from the black layers B32*b* of the scan electrodes 132. Gaps G133, each having a predetermined width, may be formed between the first and second black projections 133*a* and 133*b* on the second barrier member 16*b* that is the non-discharge region.

The first and second black projections 133*a* and 133*b* may have substantially the same function and effect as the first and second black projections 33*a* and 33*b* of the first embodiment.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel, comprising:

first and second substrates facing each other and spaced apart from each other;

barrier ribs between the first and second substrates, the barrier ribs defining discharge cells having discharge and non-discharge regions;

address electrodes extending in a first direction along the discharge cells; and first and second electrodes on the second substrate and extending in a second direction intersecting the first direction, wherein:

the first and second electrodes include black projections extending from the discharge region to the non-discharge region, the black projections including:

first black projections that extend from the first electrode toward the second electrode, adjacent first black projections being separated from each other by a space; and second black projections that extend from the second electrode toward the first electrode into respective spaces between adjacent first black projections, and the first black projections are on the barrier ribs, and an extending end of each first black projection in the first direction is entirely on a top edge of the barrier ribs.

2. The plasma display panel as claimed in claim 1, wherein the second black projections are on the barrier ribs, and an extending end of each second black projection in the first direction is substantially entirely on a top edge of the barrier ribs.

3. The plasma display panel as claimed in claim 1, wherein gaps are between the first and second black projections, and the gaps are interconnected and staggered in the first and second directions at the non-discharge region between adjacent discharge cells.

4. The plasma display panel as claimed in claim 1, wherein each of the first and second electrodes includes:

a transparent electrode extending toward a central portion of a respective discharge cell of the discharge cells; and a bus electrode on the transparent electrode and extending in the second direction.

5. The plasma display panel as claimed in claim 4, wherein the first black projections are integrally formed with the bus electrode of the first electrode; and the second black projections are integrally formed with the bus electrode of the second electrode.

6. The plasma display panel as claimed in claim 5, wherein the first black projections are on the barrier ribs, and an extending end of each first black projection in the first direction is substantially entirely on a top edge of the barrier ribs.

7. The plasma display panel as claimed in claim 5, wherein the second black projections are on the barrier ribs, and an extending end of each second black projection in the first direction is substantially entirely on a top edge of the barrier ribs.

8. The plasma display panel as claimed in claim 4, wherein each of the bus electrodes includes:

a white layer on the transparent electrode; and a black layer on the white layer, the black projections extending from the black layer.

9. The plasma display panel as claimed in claim 1, wherein the first and second black projections are integrally formed with the respective first and second electrodes.

10. The plasma display panel as claimed in claim 1, wherein the black projections extend in the first direction by about 60-80 μM.

11. The plasma display panel as claimed in claim 1, wherein the first black projections and the second black projections are alternately arranged in a region between the first and second electrodes.

12. A method of forming a plasma display panel, comprising:

providing first and second substrates to face and be spaced apart from each other;

providing barrier ribs between the first and second substrates to form discharge cells having discharge and non-discharge regions;

extending address electrodes in a first direction along the discharge cells;

forming first and second electrodes on the second substrate to extend in a second direction intersecting the first direction;

forming black projections on the first and second electrodes, the black projections extending from the discharge region to the non-discharge region, and the black projections including first black projections extending from the first electrode and second black projections extending from the second electrode, the first black projections being formed on the barrier ribs;

forming ends of the first black projections that extend from the first electrode toward the second electrode, adjacent first black projections being separated from each other by a space, and the extending end of each first black projection being entirely on a top edge of the barrier ribs; and forming ends of second black projections that extend from the second electrode toward the first electrode into respective spaces between the ends of adjacent first black projections.

13. The method as claimed in claim 12, further comprising forming the second black projections on the barrier ribs, wherein the extending end of each second black projection is substantially entirely on a top edge of the barrier ribs.

14. The method as claimed in claim 12, further comprising forming gaps between the first and second black projections, and the gaps are interconnected and staggered in the first and second directions at the non-discharge region between adjacent discharge cells.

15. The method as claimed in claim 12, wherein forming each of the first and second electrodes includes:

forming a transparent electrode extending toward a central portion of a respective discharge cell of the discharge cells; and forming a bus electrode on the transparent electrode extending in the second direction.

16. The method as claimed in claim 15, wherein ends of the first black projections are integrally formed with the bus electrode of the first electrode; and ends of the second black projections are integrally formed with the bus electrode of the second electrode.

17. The method as claimed in claim 12, further comprising integrally forming the first and second black projections with the respective first and second electrodes.

18. The method as claimed in claim 12, wherein the ends of the first black projections and ends of the second black projections are alternately arranged in a region between the first and second electrodes.

* * * * *